United States Patent [19]

Suzuki et al.

[11] Patent Number: 4,482,243

[45] Date of Patent: Nov. 13, 1984

[54] IMAGE FORMATION APPARATUS

[75] Inventors: Koji Suzuki, Yokohama; Kouki Kuroda; Jyoji Nagahira, both of Tokyo, all of Japan

[73] Assignee: Canon Kabushiki Kaisha, Tokyo, Japan

[21] Appl. No.: 412,808

[22] Filed: Aug. 30, 1982

[30] Foreign Application Priority Data

Sep. 8, 1981 [JP] Japan ..... 140308

[51] Int. Cl.[3] ..... G03G 15/08

[52] U.S. Cl. ..... 355/14 D; 355/3 DD

[58] Field of Search ..... 355/14 D, 3 DD, 14 R, 355/3 R, 14 E; 118/655–658, 663

[56] References Cited

U.S. PATENT DOCUMENTS

| | | | |
|---|---|---|---|
| 2,956,487 | 10/1960 | Giaimo | 95/1.7 |
| 3,805,739 | 4/1974 | Feldeisen et al. | 355/14 D |
| 4,153,364 | 5/1979 | Suzuki et al. | 355/14 D |
| 4,200,391 | 4/1980 | Sakamoto et al. | 355/3 DD |
| 4,213,693 | 7/1980 | Imai et al. | 355/3 DD |
| 4,239,374 | 12/1980 | Tatsumi et al. | 355/14 E |
| 4,292,387 | 9/1981 | Kanbe et al. | 430/102 |
| 4,306,804 | 12/1981 | Sakamoto et al. | 355/14 D |
| 4,352,553 | 10/1982 | Hirahara | 355/14 E |

*Primary Examiner*—R. L. Moses

*Attorney, Agent, or Firm*—Fitzpatrick, Cella, Harper & Scinto

[57] ABSTRACT

An image formation apparatus reproduces both an image of a text and a continuous tone image such as a photograph with excellent gradation. The AC bias voltage to be applied to a developing roller is controlled stepwise or continuously in accordance with the spatial frequency of an original.

11 Claims, 4 Drawing Figures

IMAGE FORMATION APPARATUS

BACKGROUND OF THE INVENTION

1. Field of the Invention

The present invention relates to an image formation apparatus and, more particularly, to an image formation apparatus which develops an electrostatic latent image formed on a recording medium by a developing unit to which an AC bias voltage is applied.

2. Description of the Prior Art

In a conventional image formation apparatus for performing electrostatic recording such as an electrophotographic copying machine, various image formation conditions are controlled in accordance with the conditions of an original such as the texture.

For example in order to control the image formation conditions by discriminating the density of the original, the density of the leading end of the original is sensed and the exposure is controlled in accordance with the obtained result. Alternatively, the developing bias is varied to adjust the gradation so as to form an optimal image. Still alternatively, the original is scanned while the exposure is corrected in real time, thus forming an optimal image.

In order to develop an electrostatic latent image formed on a recording body such as a photosensitive drum according to the magnetic-brush developing method, the characteristic curve of the development density as a function of the drum potential has a relatively steep leading edge as indicated by a curve (A) (solid line) shown in FIG. 4, since the distance between the photosensitive drum and the developing sleeve is great. This results in development with poor gradation. In order to form an optimal image, the leading edge characteristics must be changed.

However, according to the conventional control method of the image formation conditions as described above, the characteristic curve of the development density as a function of the drum potential during development cannot be controlled. For example, characteristic switching may not be effected between an image including mostly continuous tone portions such as a photograph and an image of black and white such as characters. Gradation may not be well controlled.

SUMMARY OF THE INVENTION

It is an object of the present invention to provide an image formation apparatus which eliminates the drawbacks mentioned above and which selects optimal image formation conditions in accordance with the contents of an original, so that excellent image formation may be performed.

It is another object of the present invention to provide an image formation apparatus which is capable of controlling a developing bias in accordance with the spatial frequency of the contents of an original.

It is still another object of the present invention to provide an image formation apparatus which is capable of controlling the frequency of an AC bias voltage to be applied to a developing unit in accordance with the magnitude of the spatial frequency of the contents of the original.

The above and other objects of the present invention will now be described in more detail.

DETAILED DESCRIPTION OF THE PREFERRED EMBODIMENTS

The preferred embodiment of the present invention will now be described with reference to the accompanying drawings.

Figure 1:
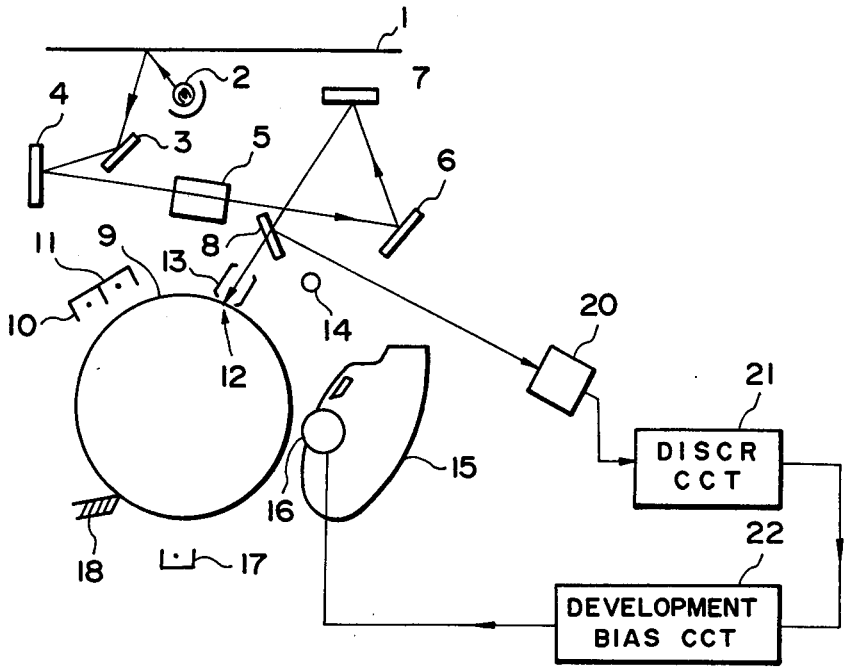
FIG. 1 is a view showing the configuration of an image formation apparatus of the present invention.

FIG. 1 shows an image formation apparatus applied to an electrophotographic copying machine. Referring to FIG. 1, below an original table 1 are arranged an illumination lamp 2, movable mirrors 3 and 4, a fixed lens 5, fixed mirrors 6 and 7, and a fixed half mirror 8. An original (not shown) placed on the original table 1 is scanned with this optical system, and one portion of the reflected light is guided onto a recording body (a photosensitive drum in this embodiment) 9 through the half mirror 8 while the other portion is reflected thereby to become incident on a photosensor 20 (e.g., an image sensor such as a CCD).

The photosensitive drum 9 comprises a photosensitive layer with a transparent insulating layer formed thereon. The photosensitive drum 9 rotates clockwise to be AC-discharged by a predischarger 10 supplied with an AC high voltage from a high voltage power supply (not shown), so that the charge on the surface of the drum is eliminated. Subsequently, the photosensitive drum 9 is uniformly charged by a primary charger 11 and then reaches an exposing unit 12. At the exposing unit 12, the reflected light from the half mirror 8 becomes incident on the surface of the photosensitive drum 9 which is AC-discharged by an AC discharger 13. In this manner, an electrostatic latent image of the original is formed on the photosensitive drum 9. The electrostatic latent image formed on the photosensitive drum 9 is provided with gradation by entire surface exposure by a lamp 14 and is visualized through a developing roller 16 of a developing unit 15. A transfer sheet (not shown) fed from a paper feed section is brought into tight contact with the photosensitive drum 9, and the image on the drum is transferred onto the transfer sheet through a transfer charger 17. The transfer sheet is then discharged outside the machine, and the residual toner on the photosensitive drum 9 is removed with a cleaner 18. The above-mentioned cycle is then repeated.

The developing unit 15 adopts the one-component development method which does not use carrier particles but uses only the toner. Jumping developing is adopted in order to achieve uniform charging of the toner and to provide a developed image of excellent gradation. As has been described earlier, according to the conventional magnetic-brush developing method, the characteristic curve of the development density as a function of the drum potential has a relatively steep leading edge as indicated by a curve (A) in FIG. 4, since the distance between the photosensitive drum and the developing sleeve is great, resulting in poor gradation. In contrast to this, in accordance with the jumping developing method, by changing the frequency of an AC bias voltage applied to the developing unit, the gradient of the characteristic curve of the development density as a function of the drum potential may be varied so that development with excellent gradation may be performed.

The output from the image sensor 20 is supplied to a discrimination circuit 21 which discriminates whether the spatial frequency of the contents of the original is high or low. The output from the discrimination circuit 21 is supplied to the developing roller 16 through a developing bias circuit 22 to control the bias voltage to be supplied to the developing roller 16. The discrimination circuit 21 is a circuit which is described, for example, in Japanese Laid-Open patent application No. 53-134437 and which discriminates the magnitude of the spatial frequency. With this circuit, the original is scanned optically or electrically during scanning of the original by the optical system, and the result is converted into an electric signal by the image sensor 20. The electric signal is converted into a high frequency component and a low frequency component. Both these components are integrated over time and are then compared at a predetermined timing. The circuit then discriminates the type of the original, a continuous tone photograph or text.

The return movement of the scanning line is the movement of the optical system from the stopped position to the exposure start position, that is, the forward movement of the optical system. Original exposure for formation of an image is performed during the return movement of the optical system.

Figure 2:
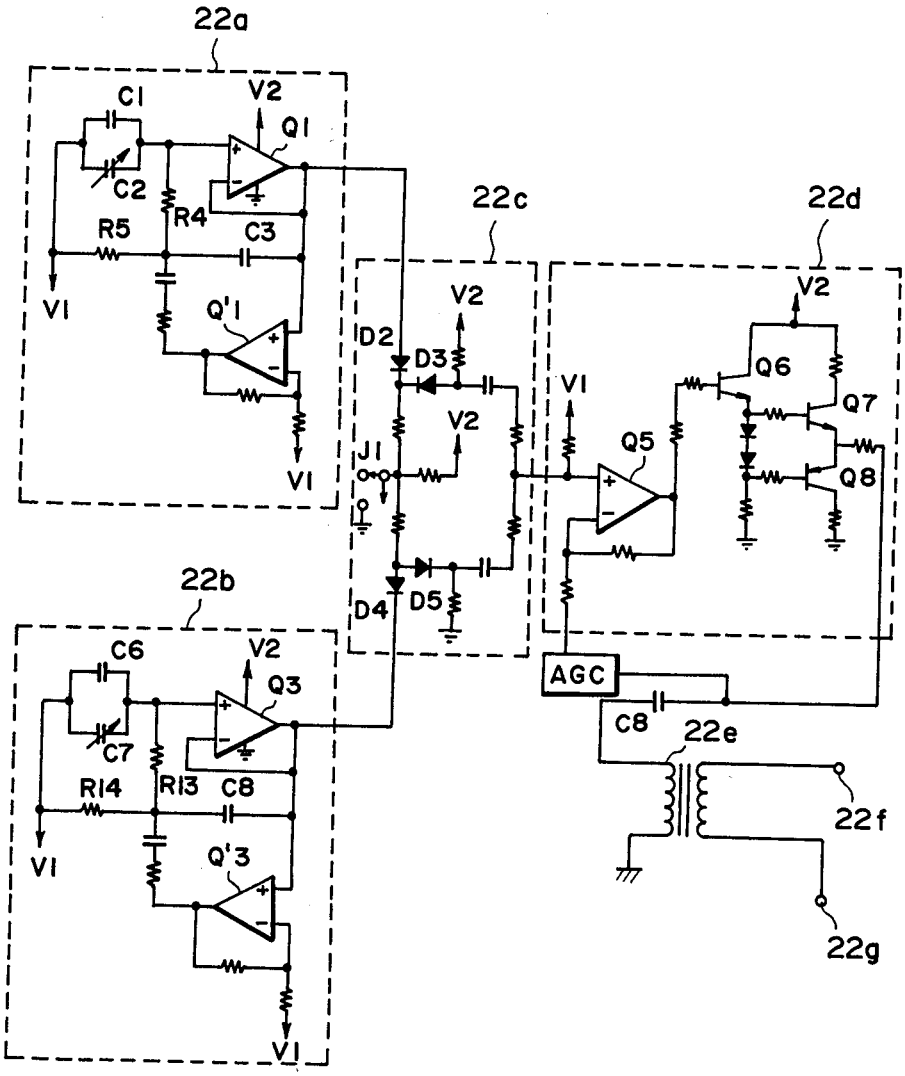
FIG. 2 is a detailed circuit diagram of a developing bias circuit.

As shown in FIG. 2, the development bias circuit 22 comprises sine wave generators **22*a* and 22*b*, a switching circuit 22*c*, an amplifier 22*d*, and a boosting transformer 22*e* coupled to the output of the amplifier 22*d*. A primary side terminal 22*f* of the boosting transformer 22*e* is connected to the developing roller 16. A DC bias voltage is applied to a secondary side terminal 22*g* of the boosting transformer 22*e***.

The sine wave generator **22*a* has a differential amplifier Q1, a capacitor C3, and resistors R4 and R5. The output from the sine wave generator 22*a* is positively fed back through a differential amplifier Q'1. The sine wave generator 22*a* is designed to generate sine waves of 800 to 1,500 Hz frequency by adjustment through, for example, a capacitor C2. The sine wave generator 22*b* generates sine waves of 200 to 600 Hz frequency by adjustment through a capacitor C7. The switching circuit 22*c* comprises diodes D2 to D5, and allows supply of the output from the generators 22*a* and 22*b* to the amplifier 22*d* in accordance with the switching operation of the terminal J1. The amplifier 22*d* comprises a differential amplifier Q5, an emitter follower Q6, and drivers Q7 and Q8 of the final stage. The emitters of drivers Q7 and Q8 are connected to the primary side of the boosting transformer 22*e* through the capacitor C8**.

In the prescanning of the optical system, or the return movement of the optical system in the arrangement as described above, the discrimination circuit 21 discriminates the contents of the original which are supplied thereto through the half mirror 8 and the image sensor 20. In accordance with whether the electric signal of the original image contains high or low frequency components, the discrimination circuit 21 discriminates the magnitude of the frequency component of the original. The discrimination result from the discrimination circuit 21 is supplied to the developing bias circuit 22. In the case of an image containing mostly continuous tone portions such as a photograph, the discrimination circuit 21 discriminates low spatial frequency and opens the terminal J1. Then, the sine wave generator **22*b* is selected, and an AC bias voltage of low frequency is applied to the developing roller 16 through the amplifier 22*d* and the boosting transformer 22*e*. An image with excellent gradation is formed. On the other hand, in the case of an image of a text such as characters whose spatial frequency is high, the terminal J1 is grounded. Then, an AC bias voltage of high frequency is applied to the boosting transformer 22*e* from the sine wave generator 22*a* through the amplifier 22*d*. The boosted AC bias voltage is thus applied to the developing roller 16. On the basis of this bias voltage, the normal copying operation is performed during the return movement of the optical system, and an image of relatively high contrast is formed. The terminal J1 may be switched by actuating a relay or the like by the output from the discrimination circuit 21**.

Figure 4:
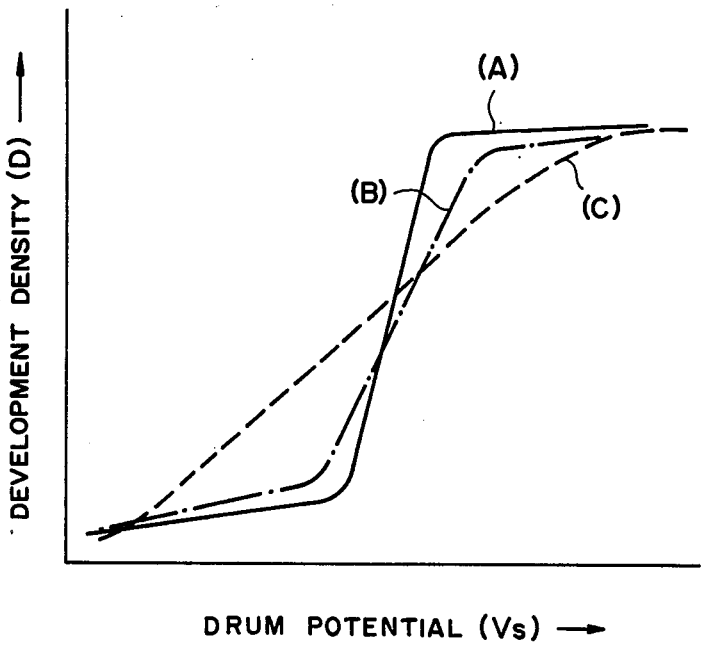
FIG. 4 is a graph showing the characteristic curves of the development density as a function of the drum potential.

If the AC bias control as described above is performed, when the sine wave generator **22*a* of high frequency is selected, the characteristic curve of the development density as a function of the drum potential becomes as indicated by a curve (B) (alternate long and short dashed line) in FIG. 4**. Therefore, an image of text such as characters is well reproduced.

If the sine wave generator **22*b* of low frequency is selected, the characteristic curve of the development density as a function of the drum potential becomes as indicated by a curve (C) (broken line) in FIG. 4**. An image including mostly continuous tone portions such as a photograph is well reproduced.

Figure 3:
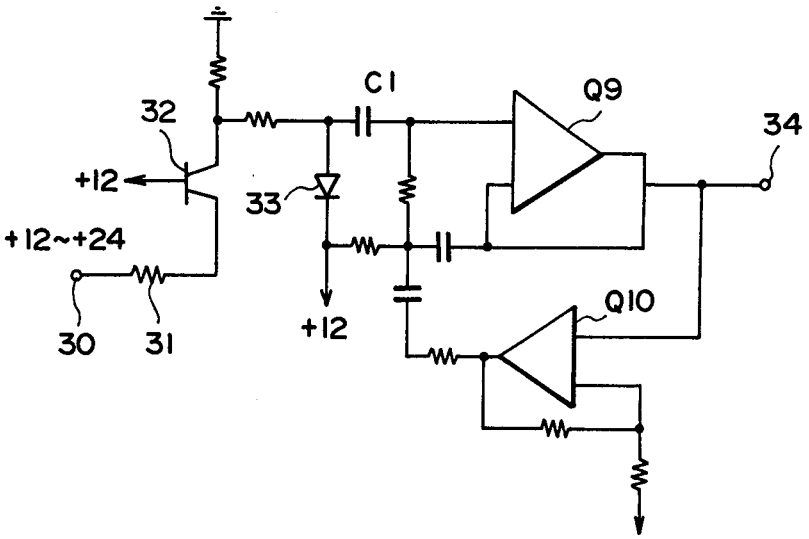
FIG. 3 is a circuit diagram of an embodiment for continuously changing the bias voltage.

In the embodiment described above, two different frequencies are selected. FIG. 3 shows another embodiment wherein the frequency is continuously changed. Referring to FIG. 3, the output from the discrimination circuit 21 is applied to a terminal 30. Unlike the case of the embodiment shown in FIG. 1, in this embodiment, the output from the discrimination circuit 21 is a linear voltage signal which is substantially proportional to the spatial frequency. Thus, the output from the discrimination circuit 21 is applied to the emitter of a transistor 32 through a resistor 31 whose base is grounded. A varactor diode 33 is connected between the positive power supply and the collector of the transistor 32. The reverse bias to be applied to the varactor diode 33 is varied in accordance with the output from the discrimination circuit 21, which is applied to the terminal 30. The junction capacitance of the varactor diode 33 changes in accordance with the output from the discrimination circuit 21 to continuously change the oscillation frequency determined by oscillation circuit Q9 and Q10. An AC bias voltage which is thus continuously changed is applied to the development roller 16 from a terminal 34 through the amplifier and the boosting transformer. In this manner, the AC bias voltage is continuously changed to adjust the gradation in accordance with the spatial frequency of the original.

In the embodiment described above, control of the charge, the exposure, and the DC components of the developing bias voltage is achieved by incorporating a potentiometer around the photosensitive drum 9, and controlling them in accordance with the output from the potentiometer. The control of the AC components of the developing bias voltage as described above is performed during original scanning as original reading control such as during prescanning, e.g., the return movement of the original or the optical system. The original scanning control may be performed during the copying operation for the first sheet or every sheet in the case of a multicopy operation. This may be performed by operation of a switch by the operator.

In the embodiments described above, the present invention is applied to a copying machine wherein the optical system is moved. However, the present invention is similarly applicable to a copying machine wherein the original is moved.

In the embodiments described above, the original is exposed during the return movement of the optical system. However, in an apparatus wherein the original is exposed during the forward movement of the optical system, prescanning is performed prior to original exposure.

In the embodiments described above, the developing bias voltage is controlled. However, the charger, the exposure lamp or the like may alternatively be controlled.

In summary, according to the present invention, the image formation conditions, for example the developing bias voltage, are controlled in accordance with the magnitude of the spatial frequency of the contents of the original. Therefore, the gradient of the characteristic curve of the development density as a function of the drum potential can be changed in accordance with the type of the image such as a photograph or text, so that reproduction of an image with excellent gradation may be realized. The apparatus of the present invention does not require frequent switching operation in accordance with the contents of the original and may be assembled into a conventional copying machine with a small number of additional parts. An inexpensive image formation apparatus may thus be provided.

What we claim is:

1. An image formation apparatus comprising:

a plurality of processing means for forming an image of an original on a recording body, said plurality of processing means having reciprocating means for exposing the original to light, developing means for developing an electrostatic latent image formed on said recording body, and means for applying a bias voltage including an AC component to said developing means;

detecting means for detecting a condition of the original in a first scanning by said reciprocating means prior to exposure of the original to light for image formation in a second scanning by said reciprocating means; and control means for controlling the bias voltage applying means to change the AC component of the developing bias voltage in the second scanning in accordance with an output from said detecting means in the first scanning.

2. An apparatus according to claim 1, wherein the detected condition is a spatial frequency.

3. An apparatus according to claim 2, wherein said control means controls an oscillation frequency of the AC component.

4. An apparatus according to claim 3, wherein said control means increases the oscillation frequency of the AC component of the developing bias voltage when the spatial frequency detected by said detecting means is high.

5. An apparatus according to claim 3, wherein said control means decreases the oscillation frequency of the AC component of the developing bias voltage when the spatial frequency detected by said detecting means is low.

6. An apparatus according to claim 3, 4 or 5, wherein said control means continuously changes the oscillation frequency of the AC component in accordance with the spatial frequency.

7. An apparatus according to claim 3, 4 or 5, wherein said control means changes stepwise the oscillation frequency of the AC component in accordance with the spatial frequency.

8. An apparatus according to claim 3, wherein said detecting means detects the spatial frequency of the original during a forward movement of said reciprocating means, and said control means controls the oscillation frequency of the AC component of the developing bias voltage during a return movement of said reciprocating means.

9. An apparatus according to claim 1, wherein said plurality of processing means have a half mirror which guides part of reflected light from the original toward said detecting means.

10. An apparatus according to claim 1 or 9, wherein said detecting means comprises an image sensor.

11. An apparatus according to claim 1, wherein said developing means further includes a one-component developer.

* * * * *